United States Patent [19]

Frohlich

[11] 4,073,132

[45] Feb. 14, 1978

[54] WATCH CASE CONSTRUCTION

[76] Inventor: Sigurd Frohlich, 22951 Aegean Sea Drive, Laguna Niguel, Calif. 92677

[21] Appl. No.: 666,887

[22] Filed: Mar. 15, 1976

[51] Int. Cl.[2] ..... G04C 3/00; G04B 37/00

[52] U.S. Cl. ..... 58/23 BA; 58/88 R; 58/23 AC; 58/23 R

[58] Field of Search ..... 58/4 A, 23 BA, 23 AC, 58/23 R, 50 R, 53, 55, 88 R, 90, 91

[56] References Cited

U.S. PATENT DOCUMENTS 3,838,568 10/1974 Zurcher ..... 58/50 R

FOREIGN PATENT DOCUMENTS 1,264,806 5/1961 France ..... 58/23 BA

*Primary Examiner*—E. S. Jackmon

[57] ABSTRACT

An electronic watch case is disclosed which comprises an inner-cover disposed within the case and switch means extending through the case. The inner-cover comprises a circular metallic member having resilient tab portions, resilient finger portions, and an aperture therein. The inner-cover is positioned with respect to the switch means and the watch batteries so that when the switch means is engaged from the exterior of the case, the batteries in the watch module are electrically coupled to associated electrical contacts. When the switch means is disengaged, it is returned to an unactuated position by the urging of one of the resilient finger portions, thereby electrically decoupling the contacts from the batteries.

8 Claims, 6 Drawing Figures

Fig. 1
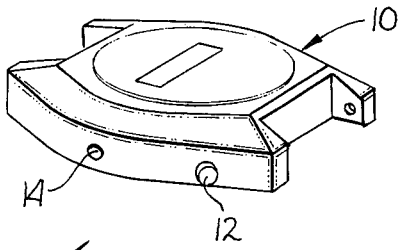
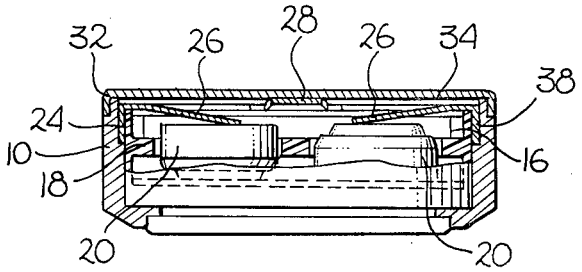
Fig. 3
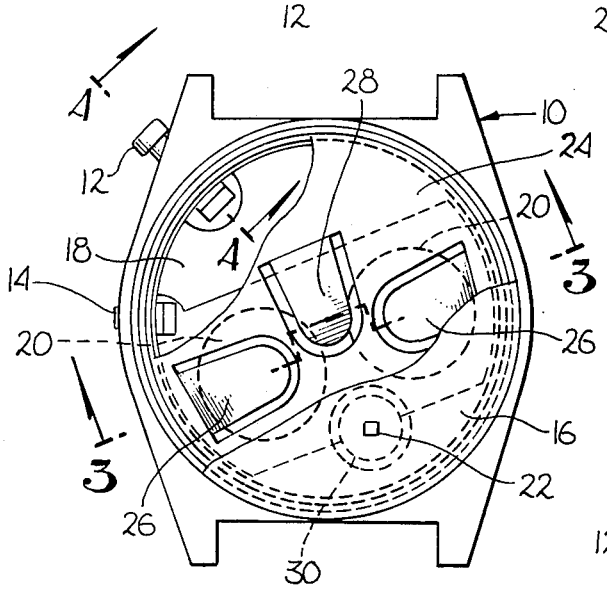
Fig. 2
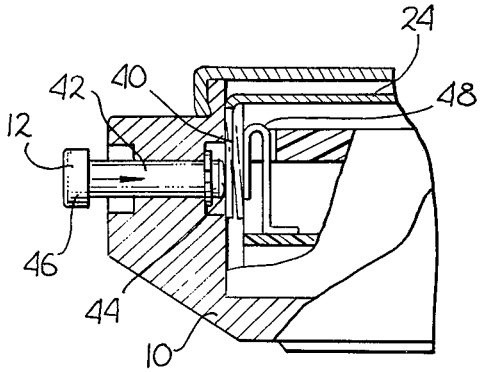
Fig. 4
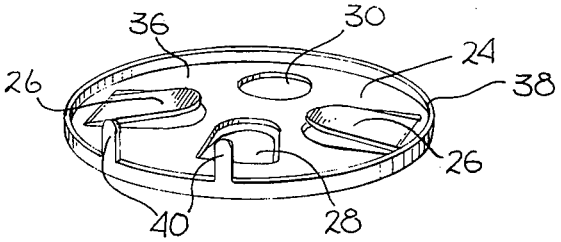
Fig. 5
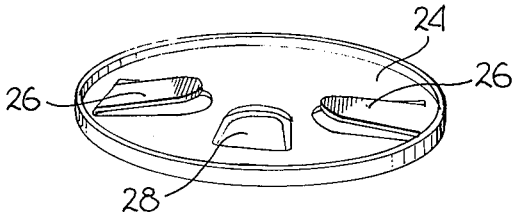
Fig. 6

WATCH CASE CONSTRUCTION

BACKGROUND OF THE INVENTION

1. Field of the Invention

The present invention relates to the field of watch cases, and more specifically, an electronic watch case.

2. Prior Art

Since the relatively recent advent of electronic digital-display wrist watches, several problems have continued to plague their construction, assembly and reliability. One difficulty has been in manufacturing a simple, yet reliable external switch by which electrical connections may be made within the watch mechanism. Another problem encountered in the prior art case construction has been in providing reliable electrical connections to batteries contained within the watch mechanism. Also, another difficulty in the prior art construction has been that the case back had to be installed before the watch would operate. Since the installation of the back, however, prevented access to timing adjustments within the case, the back would have to be removed for each adjustment and reinstalled to check the resulting timing accuracy.

One prior art attempt to provide an external switch for an electronic watch is described by Feurer, U.S. Pat. No. 3,783,607. Feurer utilizes a plunger which passes through a housing member in the watch case. The plunger moves longitudinally through the housing member, but the inward movement is opposed by a compression spring which surrounds a portion of the plunger. Thus, this method of construction requires not only sufficiently accurate machining of the case to provide for proper alignment and guidance of the plunger, but also the capability for utilizing a compression spring within the case wall. Due to the limited space available the spring must necessarily be small and fragile, and yet due to its application, must also withstand repeated compressions under varying forces. This repeated usage has the effect of stressing the spring, resulting in limited life and reliability.

One prior art attempt to provide electrical connections to batteries contained within the watch mechanism is described by Zurcher et al, U.S. Pat. No. 3,838,568. Zurcher utilizes battery hatch covers which are screwed into associated hatch openings in the back of the watch case. Disposed on the interior surface of the hatch covers are springs adapted to engage batteries in the watch mechanism. Seal rings are disposed between the hatch cover and the watch back so as to provide hermetic sealing. It can be seen from this brief description that relatively costly and complex machining is required for this construction. Not only must the small hatch covers be manufactured but corresponding screw threads must be provided on both the cover and the hole in the case back. In addition, springs and sealing rings must also be provided. Besides being complex, this construction requires a bulky back member so as to provide adequate surface area for screw threads to be disposed thereon, and watertight sealing is further compounded by two additional openings in the case.

In the present invention the problems of complex construction, lack of reliability and inconvenience of assembly, have been solved by utilizing a simple but effective inner-cover member in conjunction with a greatly simplified switch construction. The inner-cover, consisting of a stamped metallic member, not only provides reliable electrical connections to the watch batteries but completely replaces the switch return spring of the prior art. In addition, the inner-cover provides the necessary coupling of the watch batteries to electrical contacts on the watch mechanism upon actuation of the switch.

BRIEF SUMMARY OF THE INVENTION

The present invention is an electronic watch case which provides electrical interconnection of components within the case upon actuation of a uniquely designed switch means. The watch case comprises a cavity which is closed by a back member. Disposed within the cavity, along with an electronic watch module, is an inner-cover having resilient tab portions which engage the interior surface of the case back member and electrical battery terminals disposed on one surface of the watch module. These resilient tab portions engaging the back member is flexibly stressed so as to urge the other resilient tab portions into a stressed engagement with the battery terminals. Also disposed on the inner-cover are electrically conductive resilient finger members configured so as to engage and urge an associated switch means into an unactuated position. These finger members are further configured such that when the switch means is actuated, an associated finger member engages an electrical contact on the watch module, thereby electrically coupling the battery terminals to the electrical contact. Since the finger members provide the return force for the associated switch means, the switch means is simply designed so as to merely comprise a cylindrical shaft slideably disposed through the watch case, with circular-shaped stop portions disposed at each end.

The present invention allows relatively simple construction and assembly techniques since both the resilient tab portions and finger members may be mechanically stamped from the inner-cover member. The resulting resilient portions provide reliable, yet simple, means for electrically interconnecting components within the case while eliminating the complex and difficult to assemble return spring associated with prior art switch means. The inner-cover further provides convenience in assembling the watch module in the case since apertures in the inner-cover allow access to internal components of the watch module while the module is operating.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only, and is not intended as a definition of the limits of the invention.

BRIEF DESCRIPTION OF THE DRAWINGS

FIG. 1 is a perspective view of the electronic watch case;

FIG. 2 is a cutaway view of the interior of the watch case illustrating the relationship of the inner-cover, watch switches and electronic watch module;

FIG. 3 is a cross-sectional view taken on substantially the line 3—3 of FIG. 2;

FIG. 4 is an enlarged cross-sectional view taken on substantially the line 4—4 of FIG. 2;

FIG. 5 is a perspective view of the preferred embodiment of the inner-cover;

FIG. 6 is a perspective view of a second embodiment of the inner-cover.

DETAILED DESCRIPTION OF THE INVENTION

Referring first to FIGS. 1 and 2, electronic watch case 10 is shown with switch means 12 and 14 disposed through case 10. Within the cavity 16, formed by the case 10, is the electronic watch module 18 which contains batteries 20 and adjustable electrical element 22. Also illustrated in FIG. 2 is an electrically conductive inner-cover 24 with its resilient tab portions 26 and 28, and its aperture 30. The inner-cover 24 is positioned within the case cavity 16 such that resilient tab portions 26 engage batteries 20, while aperture 30 exposes adjustable element 22.

Now referring to FIG. 3, electronic watch case 10 is shown with its cavity 16 formed by the case and its back member 32. Disposed within cavity 16 is the electronic watch module 18 containing batteries 20, and inner-cover 24 which coaxially surrounds the upper portion of watch module 18. Descending from inner-cover 24 are resilient tab portions 26 which are shown resiliently engaging batteries 20. Ascending from inner-cover 24 is tab portion 28 which is shown resiliently engaging interior surface 34 of back member 32.

FIG. 5 shows in greater detail one preferred embodiment of inner-cover 24. The inner-cover comprises a generally flat circular member having an upper surface 36 and a side surface 38 configured so as to extend perpendicularly from the periphery of upper surface 36. This side surface 38 is further configured so as to circumferentially engage one end of electronic module 18, as illustrated in FIG. 3. Extending upward from upper surface 36 are resilient tab portions 26 of inner cover 24. Extending downward from the inner cover 24 is another resilient tab portion 28. In this preferred embodiment, both sets of tab portions 26 and 28 may be simply formed by appropriately stamping and bending a portion of metallic member 24. Also illustrated in FIG. 5 is the aperture 30 disposed through inner-cover 24; this aperture is configured so as to expose adjustable electrical element 22, as shown in FIG. 2. Finger portions 40 are also illustrated extending from side surface 38 in a generally perpendicular orientation from the periphery of upper surface 36.

By reference to FIGS. 2, 3 and 5, it may be seen that inner-cover 24 may be disposed within the case cavity 16 such that tab portions 26 resiliently engage batteries 20, thereby electrically coupling batteries 20 to the electrically conductive inner-cover 24 and finger portions 40. The tab portions 26 are urged into this resilient engagement by the force exerted by the stressed engagement of tab portion 28 with the interior surface 34 of back member 32. Tab portion 28 supplies sufficient force so as to flex tab portions 26 and thereby firmly engage batteries 20. Thus, the inner-cover 24 and its tab portions 26 and 28 provide simple, yet reliable, electrical interconnections within the watch case.

Now referring to FIG. 4, switch means 12 may be seen in its relationship with case 10. In the presently preferred embodiment, switch means 12 comprises a cylindrical shaft member 42 slideably disposed through case 10, with interior stop means 44 and exterior stop means 46. Interior stop means 44 is configured so as to limit outward axial movement of shaft member 42 by abutting the interior surface of case 10 when shaft 42 has moved to its outward limit. Similarly, exterior stop means 46 is configured so as to limit inward axial movement of shaft 42 by abutting the exterior surface of case 10 when shaft 42 has moved to its inward limit.

Also illustrated in FIG. 4 is the relationship between switch means 12, finger portion 40, and watch module electrical contact 48. Interior stop means 44 is engaged by finger portion 40 such that finger portion 40 urges switch means 12 axially outward to its unactuated position. However, when switch means 12 is engaged from outside the case 10, its inward axial displacement flexes finger portion 40 toward electrical contact 48. When switch means 12 has been moved to its maximum inward displacement, its actuated position, finger portion 40 will be flexed so as to electrically couple finger portion 40 and electrical contact 48. In this actuated position the batteries 20 disposed in watch module 18 will be electrically coupled to contact 48, via electrically conductive tab portions 26, and finger portion 40. When switch means 12 is released from outside the case 10, it is returned to its unactuated position by the urging of flexed finger portion 40, thereby electrically decoupling batteries 20 from contact 48. Thus, inner-cover 24 with its finger portions 40 provides a convenient and reliable return mechanism for the switch means 12, thereby allowing a greatly simplified switch means construction while providing electrical coupling with electrical contacts on the watch module.

Now referring to FIG. 6, a second embodiment of inner-cover 24 is illustrated. This form of the inner-cover may be utilized in an electronic watch case having a switch means with an integral return spring. In this embodiment tab portions 26 are configured so as to engage batteries in an electronic watch module, while tab portion 28 engages the interior surface of the back member of a watch case. Tab portion 28 then serves the dual function of urging tab portions 26 toward the batteries, thereby making firm, secure connections, and electrically coupling the batteries to the back member of the watch case.

There has been described herein a new and novel electronic watch case which simply but effectively provides electrical interconnections within an electronic watch module. While two specific embodiments of the present invention have been disclosed and described in detail herein, it will be understood by those skilled in the art that various changes in form and detail may be made therein without departing from the spirit and scope of the invention.

I claim:

1. An electronic watch comprising:

a. a case forming a cavity, said cavity adapted to receive an electronic watch module, said watch module having electrical battery terminals disposed on one surface thereof;

b. a back member disposed on said case so as to close said cavity, said member having an interior surface;

c. an inner-cover disposed within said case to engage said interior surface of said back member, and resiliently engage said terminals of said module, said inner-cover comprising:

i. a generally flat circular cover member, said cover member comprising upper, lower and side surfaces, said side surfaces structured and configured so as to extend perpendicularly from the periphery of said upper surface, such that said side surface may circumferentially engage said watch module, said cover member being electrically conductive, ii. coupling means for electrically coupling said electrical battery terminals of said watch module to said cover member, said coupling means comprising at least one resilient tab portion of said cover member structured and configured so as to have one end of said tab portion coupled to said upper surface of said cover member while having the remainder of said tab portion protruding upward from said cover member such that said protruding portion resiliently engages said electrical battery terminals, thereby flexing said resilient tab such that said portion firmly engages said battery terminals;

iii. spring means for urging said coupling means toward said electrical battery terminals, said spring means comprising at least one resilient tab portion of said cover member structured and configured so as to have one end of said tab portion coupled to said lower surface of said cover member while having the remainder of said tab portion protruding downward from said cover member such that said protruding portion resiliently engages said interior surface of said back member, thereby flexing said resilient tab such that said coupling means is urged toward said battery terminals, resulting in electrical coupling of said battery terminals, said cover member and said back member.

2. An electronic watch case comprising:

a. a case forming a cavity, said cavity adapted to receive an electronic watch module, said watch module having battery terminals disposed on one surface thereof, and an adjustable electrical element;

b. a back member disposed on said case so as to close said cavity, said member having an interior surface;

c. an inner-cover disposed within said case for resiliently engaging said battery terminals of said module via an electrically conductive coupling means disposed on said inner-cover, said coupling means electrically coupling said battery terminals to said inner-cover, said inner-cover further including electrically conductive spring means disposed on said inner-cover to engage said interior surface of said back member and urge said coupling means toward said electrical battery terminals; said spring means further adapted to electrically couple said cover member and said battery terminals to said back member; and d. at least one switch means disposed through said case, said switch means having actuated and unactuated positions.

3. In an electronic watch case having a cavity adapted to receive an electronic watch module, said watch module having contacts, including battery terminals, disposed on one surface thereof, and a back member disposed on said case so as to close said cavity, said member having an interior surface, the improvement comprising:

i. an inner-cover disposed within said case to engage said interior surface of said back member, said inner-cover resiliently engaging said contacts of said module via an electrically conductive coupling means for electrically coupling said battery terminals of said watch module to said inner-cover member, said coupling means disposed on said inner-cover member so as to resiliently engage said battery terminals; and ii. electrically conductive spring means disposed on said inner-cover so as to engage said back member and urge said coupling means toward said battery terminals, said spring means further adapted so as to electrically couple said cover member and said battery terminals to said back member.

4. In an electronic watch case having (i) a cavity adapted to receive an electronic watch module, said watch module having electrical battery terminals disposed on one surface thereof, electrical contacts disposed about its periphery, and an adjustable electrical element, (ii) a back member having an interior surface, and (iii) at least one switch means disposed through said case, said switch means having actuated and unactuated positions, the improvement comprising: an inner-cover disposed within said case for resiliently engaging said terminals of said module via an electrically conductive coupling means disposed on said inner-cover, said coupling means electrically coupling said battery terminals of said watch module to said inner-cover, said inner-cover forming an electrically conductive path from said contacts, and adapted to engage said interior surface of said back member via electrically conductive spring means disposed on said inner-cover so as to urge said coupling means toward said electrical battery terminals, said inner-cover further adapted to electrically couple said cover member and said battery terminals to said back member, said inner-cover further including at least one aperture through the surface thereof, said aperture being positioned so as to expose said adjustable electrical element.

5. The structure recited in claim 2 wherein said inner-cover includes at least one electrically conductive, resilient finger member, each said finger member disposed on said surface of said cover member so as to urge an associated switch means into said unactuated position, each said finger member further arranged and configured such that when said switch means is engaged said contacts are electrically coupled to said cover member and to said battery terminals, and when said switch means is disengaged said contacts are electrically decoupled from said cover member and said battery terminals.

6. The improvement of claim 3 wherein said inner-cover comprises:

i. a generally flat circular cover member, said cover member comprising upper, lower and side surfaces, said side surfaces structured and configured so as to extend perpendicularly from the periphery of said upper surface, such that said side surface may circumferentially engage said watch module, said cover member being electrically conductive;

ii. coupling means for electrically coupling said electrical battery terminals of said watch module to said cover member, said coupling means comprising at least one resilient tab portion of said cover member structured and configured so as to have one end of said tab portion coupled to said upper surface of said cover member while having the remainder of said tab portion protruding upward from said cover member such that said protruding portion resiliently engages said electrical battery terminals, thereby flexing said resilient tab such that said portion firmly engages said battery terminals;

iii. spring means for urging said coupling means toward said electrical battery terminals, said spring means comprising at least one resilient tab portion of said cover member structured and configured so as to have one end of said tab portion coupled to said lower surface of said cover member while having the remainder of said tab portion protruding downward from said cover member such that said protruding portion resiliently engages said interior surface of said back member, thereby flexing said resilient tab such that said coupling means is urged toward said battery terminals, resulting in electrical coupling of said battery terminals, said cover member and said back member.

7. The improvement of claim 4 wherein the inner-cover forms an electrically conductive path from said contacts by at least one finger member, said finger member electrically couples said contacts of said watch module to said battery terminals upon actuation of said switch means, and urges an associated switch means into said unactuated position.

8. The improvement of claim 7 wherein the inner-cover comprises:

i. a generally flat circular cover member, having at least one aperture therein, said aperture being positioned so as to expose said adjustable electrical element, said cover member comprising upper, lower and side surfaces, said side surfaces structured and configured so as to extend perpendicularly from the periphery of said upper surface, such that said side surface may circumferentially engage said watch module, said cover member being electrically conductive;

ii. coupling means for electrically coupling said electrical battery terminals of said watch module to said cover member, said coupling means comprising resilient tab portions of said cover member structured and configured so as to have one end of said tab portion coupled to said upper surface of said cover member while having the remainder of said tab portion protruding upward from said cover member such that said protruding portion resiliently engages said electrical battery terminals, thereby flexing said resilient tab so that said portion firmly engages said battery terminals;

iii. at least one spring means for urging said coupling means toward said electrical battery terminals, each said spring means comprising resilient tab portions of said cover member structured and configured so as to have one end of said tab portion coupled to said lower surface of said cover member while having the remainder of said tab portion protruding downward from said cover member such that said protruding portion resiliently engages said interior surface of said back member, thereby flexing said resilient tab so that said coupling means is urged toward said battery terminals;

iv. at least one finger member for electrically coupling said contacts of said watch mechanism to said battery terminals upon actuation of said switch means and for urging an associated switch means into said unactuated position, said finger member comprising electrically conductive resilient finger portions protruding from said side surface of said cover member in a generally perpendicular orientation from the periphery of said upper surface, each of said finger members arranged and configured so as to: (i) engage said interior stop means of an associated switch means, said resilient member being stressed to urge said switch means into said unactuated position, (ii) engage said electrical contacts on said watch module when said switch means is engaged from said unactuated to said actuated position, thereby electrically coupling said contacts to said battery terminals, (iii) disengage said electrical contacts when said switch means returns from said actuated position to said unactuated position, thereby electrically decoupling said contacts from said battery terminals.

* * * * *